US006536528B1

(12) United States Patent
Amin et al.

(10) Patent No.: US 6,536,528 B1
(45) Date of Patent: Mar. 25, 2003

(54) EXTENDED REACH TIE-BACK SYSTEM

(75) Inventors: Raj M. Amin, Houston, TX (US); Andrea Mangiavacchi, Houston, TX (US); Nicolaas Vandenworm, Houston, TX (US); James F. O'Sullivan, Houston, TX (US); Clyde E. Nolan, Jr., Sugar Land, TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 21 days.

(21) Appl. No.: 09/675,623

(22) Filed: Sep. 29, 2000

Related U.S. Application Data

(63) Continuation of application No. PCT/US99/06964, filed on Mar. 30, 1999.

(60) Provisional application No. 60/108,199, filed on Nov. 13, 1998, and provisional application No. 60/079,908, filed on Mar. 30, 1998.

(51) Int. Cl.[7] ..... E21B 43/01; E21B 41/04

(52) U.S. Cl. ..... 166/369; 166/366; 166/368; 166/352

(58) Field of Search ..... 166/335, 350, 166/351, 352, 354, 366, 368, 369

(56) References Cited

U.S. PATENT DOCUMENTS 3,469,627 A * 9/1969 Baker ..... 166/356
3,504,740 A * 4/1970 Manning ..... 166/356
3,504,741 A * 4/1970 Baker et al. ..... 166/356
3,855,656 A * 12/1974 Blenkarn ..... 166/350
4,730,677 A 3/1988 Pearce et al. ..... 166/345
4,768,984 A * 9/1988 de Oliveira et al. ..... 441/21
5,226,482 A * 7/1993 Giannesini et al. ..... 166/353
5,295,546 A * 3/1994 Giannesini et al. ..... 166/353
5,778,981 A * 7/1998 Head ..... 166/345
6,102,124 A * 8/2000 Skeels et al. ..... 166/347
6,155,748 A * 12/2000 Allen et al. ..... 166/350
6,328,107 B1 * 12/2001 Maus ..... 166/335

* cited by examiner

*Primary Examiner*—William Neuder
*Assistant Examiner*—Jennifer H Gay
(74) *Attorney, Agent, or Firm*—Conley, Rose & Tayon, P.C.

(57) ABSTRACT

A system for producing hydrocarbons from a subsea well comprises an unmanned floating platform positioned over the well, the platform including equipment for inserting coiled tubing or wireline tools or the like into the well for servicing, controlling, or conducting other operations in or to the well, a vertical access riser connecting the platform to the well, a control umbilical connecting the platform to the well, a host facility adapted to receive the produced hydrocarbons, and aproduction pipeline connecting the well to the host facility, the production pipeline including at least one access port between the well and the host facility.

36 Claims, 2 Drawing Sheets

EXTENDED REACH TIE-BACK SYSTEM

REFERENCE TO RELATED APPLICATIONS

This is a continuation of International Application PCT/US99/06964, with an International filing date of Mar. 30, 1999 which claims priority from provisional applications Serial Nos. 60/079,908 filed Mar. 30, 1998 and entitled EXTENDED REACH TIE-BACK SYSTEM and 60/108,199 filed Nov. 13, 1998 and entitled EXTENDED REACH TIE-BACK SYSTEM.

STATEMENT REGARDING FEDERALLY SPONSORED RESEARCH OR DEVELOPMENT

Not Applicable.

BACKGROUND OF THE INVENTION

As the current trend in offshore oil and gas production advances into deeper waters, and the oil and gas prices remain depressed, it is becoming increasingly necessary for the industry to develop cost effective solutions to develop small fields in deep waters.

A typical solution for such cases is to keep the production facilities on a "host platform" and connect the deep-water well(s) to the platform with pipelines and risers. The supporting equipment for the subsea tree control, such as hydraulic and electric power units, chemical injection pumps and tanks, and a control console, are also housed on the host platform. The subsea tree control is accomplished via long umbilical(s) consisting of electric conductors, hydraulic lines and chemical injection lines laid alongside the pipeline. In addition, two parallel pipelines are necessary to accomplish the roundtrip pigging operations. Obviously, the cost and technical challenges of this conventional tie-back system increase as the tieback distance increases, and to a lesser extent as the water depth increases. For most cases, 20 miles represents the practical limit for the maximum tieback distance with the conventional tieback system. Hence, it is desired to provide a system that can provide greater tieback distances without the cost and technical disadvantages that heretofore have prevented increasing the tieback distance.

SUMMARY OF THE INVENTION

According to the present invention, a permanent low-cost multi-function surface support facility is provided that allows for several functions associated with well operation to be provided from a permanent local structure. According to a preferred embodiment, the permanent local structure comprises an unmanned mini-floating platform that supports equipment such as equipment for subsea tree control, hydraulic and electric power units, chemical injection pumps and tanks, and the associated control console(s). The present mini-floating platform is preferably positioned substantially directly over the subsea tree(s) and manifolds. Hence, the subsea tree is connected via a much shorter umbilical cable to the floating platform. The control for equipment on the mini-platform, including the power and chemical injection units, is preferably accomplished via a links to a remote host platform, such as microwave, satellite, radio, etc. The present mini-floating platform can also support a vertical access riser for well workover and/or pigging equipment for pipeline maintenance, and provides surface support for subsea production systems such as pumps, meters, separators etc.

The present invention eliminates the need for very long umbilical cables and the very long pipelines needed for pigging. Thus, cost savings are associated with the reduction in length of all but the production pipeline. The present novel approach to the production and control of subsea wells is accomplished by splitting the control and production requirements between a host facility and a local platform, allowing significant advantages and cost savings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Basic System

Figure 1:
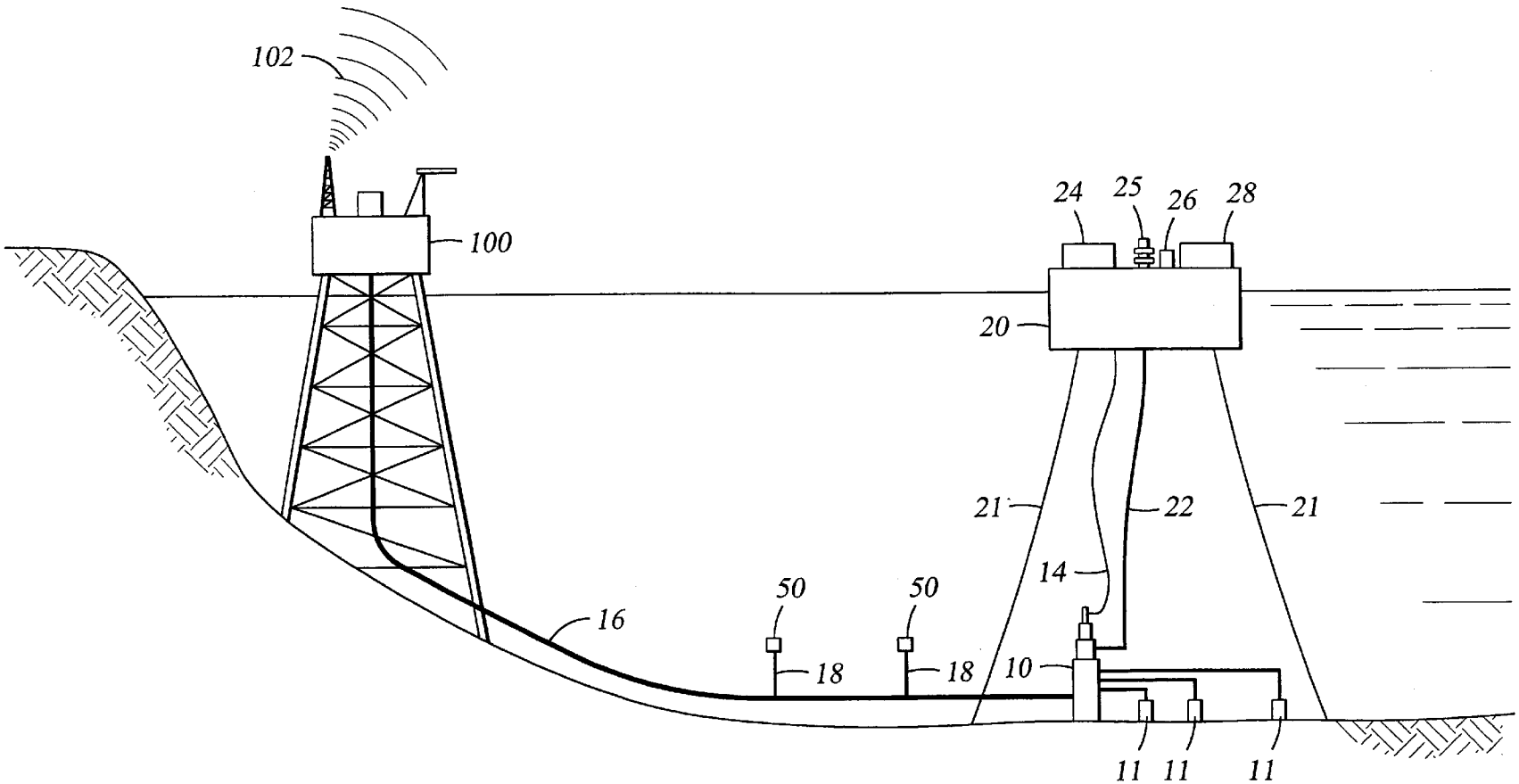
FIG. 1 is a schematic diagram of one preferred embodiment of the system of the present system.

The present extended tieback system is a cost-effective solution for extending the tieback range. Referring initially to FIG. 1, a preferred embodiment of the present extended tieback system comprises a normally unmanned floating platform 20 directly over the subsea tree(s) and manifold 10. In its simplest form, floating platform 20 is a "control buoy" that supports the control system equipment for the subsea equipment 10. The subsea tree is connected via a much shorter umbilical cable 14 to the control buoy above the well(s). Thus, the connection from the subsea equipment to the host platform 100 is reduced to the product flow lines 16 and chemical injection umbilical lines 18.

Platform 20 is preferably an small, unmanned floating platform (or buoy) that is permanently moored above the wells and subsea equipment 10 by conventional mooring means 21, thereby eliminating the need for tying back the control umbilical to the hoot facility 100. Subsea equipment 10 can be a wellhead, or a manifold providing fluid access to multiple wellheads 11. A riser 22 connects equipment 10 to equipment on platform 20, which can include coil tubing and/or wireline access equipment 24, blowout prevention equipment 25, chemical injection equipment 26, and/or pigging equipment 28, and/or other equipment for servicing, controlling or conducting other operations in or on the well. Operations that can be performed through riser 22 can include, but are not limited to: well workovers, light interventions, well logging, production enhancement, water injections, methanol injections, subsea tree maintenance and inspection and well abandonment service support. In some limited instances, it may be desirable to omit riser 22 from the system.

Host facility 100 can be a fixed platform, floating production system (FPS), or land-based facility. At least one flow line 16 connects subsea equipment 10 to the host facility. The floating platform 20 provides a connection point for the control umbilical 14, necessary electrical and hydraulic power, chemical injection, chemical storage, and data transmission. It is preferred, but not necessary, that platform 20 be unmanned. If platform 20 is manned, additional systems are required to support personnel, including safety equipment, power generation and accommodations. Platform 20 can also be used for ROV support. An ROV can be used to provide power to the lower riser package, so as to enable it to move from one subsea tree to the next.

In addition to the equipment mentioned above, monitoring and treatment equipment can be located on platform 20, along with controls, power generator(s) and equipment that allows access to the well annulus. Power generation equipment may include diesel generators or the like, and typically operates more efficiently if motion is minimized. Fuel for the power generator(s) is either stored or obtained from the produced fluids. Control for the equipment on platform 20, including power units, well intervention, and chemical injection equipment is preferably accomplished via microwave 102 or satellite links to the host platform.

Figure 2:
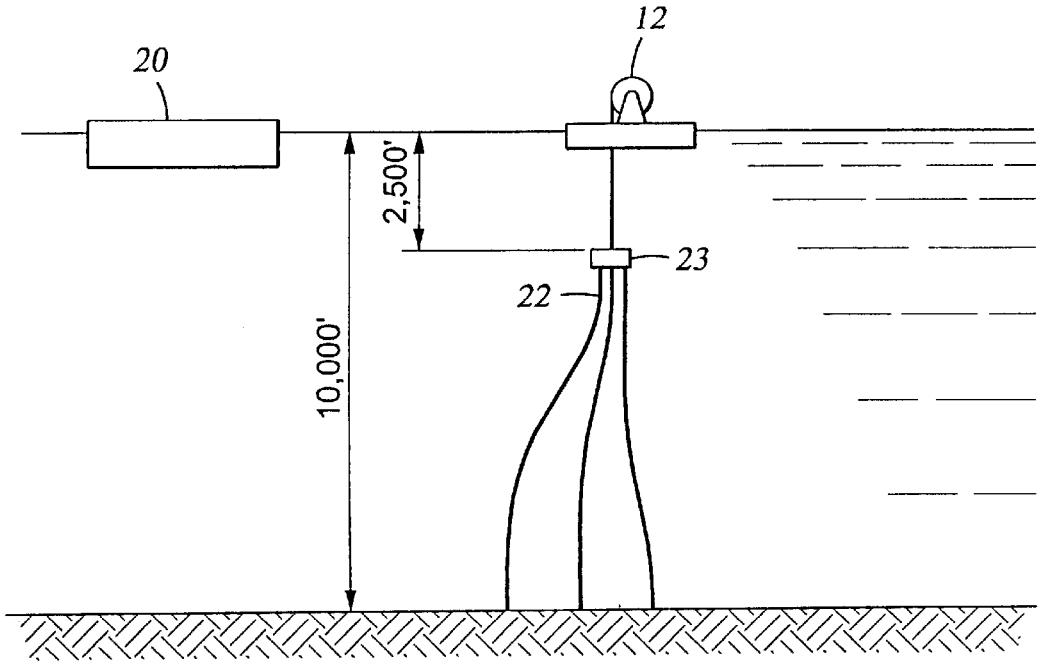
FIG. 2 is a schematic diagram of a preferred embodiment of a subsurface riser termination at a reservoir for use in the present system.
Figure 3:
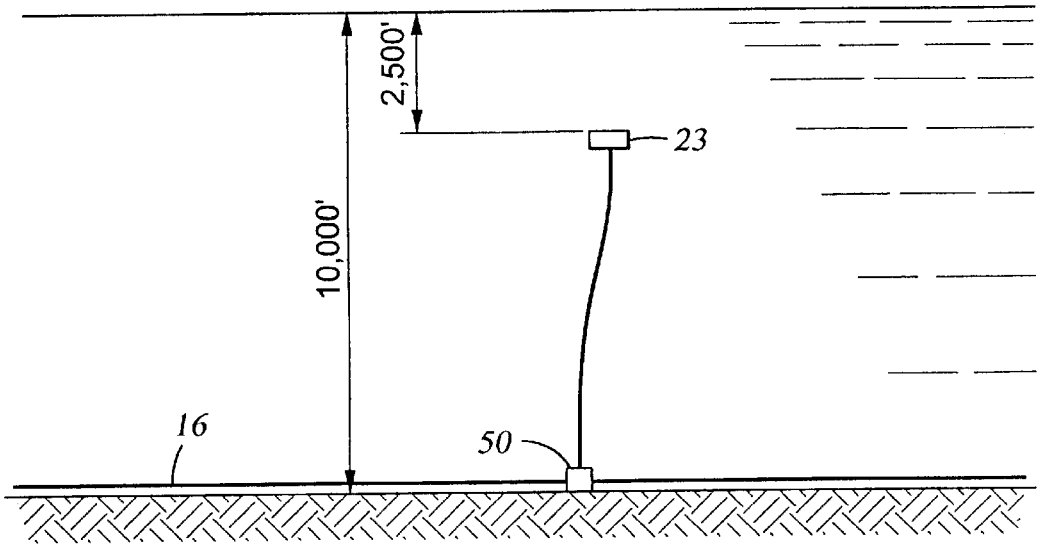
FIG. 3 is a schematic diagram of a preferred embodiment of a subsurface riser termination at a point along a production flowline for use in the present system.

Additional, optional equipment increases the capabilities of the present system. Chemical injection equipment and vertical umbilical(s) are preferably included, so as to eliminate the long umbilical(s) for flow assurance. Subsea flow assurance modules and/or pipeline intervention schemes are preferably included at intervals along the production pipeline, where necessary, to accomplish flow assurance for long flowlines. These can include various wax removal and/or wax mitigation systems and hydrate suppression/management. A compliant vertical access riser (CVAR) is preferably included for applications where well intervention services are frequently required. This type of riser is disclosed in detail in U.S. Pat. No. 4,730,677, incorporated herein by reference in its entirety. FIGS. 2 and 3 illustrate subsurface riser terminations at the reservoir and at a point along production flowline 16, respectively, and are discussed in greater detail below. A preferred riser 22 includes equipment for splitting blowout prevention, using valves in the lower riser package (LRP) and at the surface. Because of the flexibility of the riser, greater time is allowed for emergency disconnects.

This present tieback system provides for reliable flow assurance and permits well interventions and pipeline interventions to be performed in time and cost effective manner, by either coiled tubing and/or wire line intervention equipment. In addition, the present system offers opportunity to reduce operating expenses by providing cost effective solutions for operation and maintenance requirements, for example:

1. The present system is preferably capable of supporting coiled tubing (CT) and/or wireline equipment 24 operated though the vertical access riser for light intervention and other operations. This eliminates the need for assembling the riser and mobilizing/de-mobilizing a drilling rig/workover vessel to perform these tasks, as has been required in the prior art. As such, this system reduces operating expenses and the time required for the intervention, thus reduces down time and improves reliability. Alternatively, as shown in FIG. 2, coiled tubing equipment 12 can be provided on a separate piece of equipment that temporarily connects to riser 22 in place of platform 20. In either case, it may be desirable to provide access to the well(s) by means of a sub-surface riser termination 23, which is preferably positioned about 2,500 feet below the surface. This reduces the effect of waves and wind on the riser termination and reduces the threat of interference with objects deployed from the surface.
2. The present system preferably houses pigging equipment 28 for flowline maintenance, eliminating the need for a second flowline that would otherwise be required in order to provide a round trip for the pig. The pig can be launched through the riser 22 or subsea.
3. The present system preferably provides surface support for subsea production systems/flow assurance modules such as multi pumps, meters, separators etc., which provide cost effective flow assurance capability and further enhance the life cycle cost savings.

Therefore, the present extended tieback system has particular utility for developing small/marginal fields in deep waters, which would not be developed otherwise. The following detailed information is intended to be exemplary only, and is not intended to limit the scope of the invention.

Well and/Pipeline Intervention Option

Access to the wells and flow lines is provided for coiled tubing and wire line operations, to carry out flow assurance, maintenance and workover. Two main alternatives for well access are contemplated. According to the first option, floating platform size is kept to a minimum and all workover equipment is provided on a separate custom workover vessel. In the second option, handling facilities and space for the coiled tubing equipment are provided on floating platform 20. In this case, the platform has to be larger than would otherwise be necessary. Certain instances can significantly affect the size of the platform. For example, if it is desired to pull casing using platform 20, sufficient space must be provided to allow for storage of the pulled casing. Similarly, some types of tubing pulling, such as pulling tubing in horizontal trees require enhanced buoyancy and may be beyond the capability of platform 20.

Workover procedures that can be performed from the floating platform 20 include pigging, well stimulation, sand control, zone isolation, re-completions and reservoir/selective completions. For example, and ROV can be located on platform 20, since power is provided. Platform 20 can also be used to support storage systems for fuels, chemicals for injection, and the like.

Riser System Options

According to the present invention, the system can be used with a single riser for the entire field, or with multiple risers for the field. In the latter case, the multiple risers can be supported by floating platform 20, or can be terminated subsurface. In a preferred embodiment, motion of platform 20 can be minimized in accordance with the teachings of U.S. Pat. No. 4,730,677. In this case, a flexible and buoyant pipe with a steel upper riser or a composite pipe with a steel upper riser are preferred.

Wet trees are preferred for the present application because dry trees require production to the surface. Because vertical access is needed, horizontal trees are preferred. In addition, because the system is preferably set up with a compliant vertical access riser, dry trees are not preferred for the present application.

Flow Assurance

In order to facilitate flow through the very long production lines made possible by the present system, it is preferred to provide various flow assurance devices as part of the total system. Referring to FIGS. 1 and 3, these can include access ports 50 located at intervals along the subsea production line. As shown in FIG. 3, ports 50 can, if desired, include sub-surface risers having terminations 23 at about 2,500 feet below the surface. Ports 50 are preferably adapted to provide access for subsea pumping, chemical injection and/or pigging. In addition, a preferred embodiment of the present system includes equipment for mitigating wax buildup in the production line, either by including chemicals that reduce wax formation, or by including processing equipment that causes wax formation in a controlled environment such that the wax particles can be suspended in the process fluid. This process reduces their tendency to clog the pipeline. It is further possible but not necessary that an insulated or heated production pipeline be used in conjunction with the present system. Alteratively, the access ports 50 can be adapted to allow the injection of heated fluids into the production line, so as to provide localized warming of the production fluid if desired, as a remedial action.

The present invention provides a novel approach to the production and control of subsea wells. By splitting the control and production requirements between a host facility and a local platform, significant advantages and cost savings can be realized.

What is claimed is:

1. A system for producing hydrocarbons from a deep subsea well, comprising:

a floating platform positioned over the deep well;

a vertical access riser connecting said platform to the deep well, a control umbilical connecting said platform to the well;

a host facility adapted to receive the produced hydrocarbons; and a production pipeline connecting the deep well to said host facility without passing through said floating platform.

2. The system according to claim 1 wherein said platform includes equipment for inserting coiled tubing into the well.

3. The system according to claim 1 wherein said platform includes well intervention equipment.

4. The system according to claim 1 wherein said platform includes storage for chemicals.

5. The system according to claim 1 wherein said platform includes chemical injection equipment.

6. The system according to claim 1 wherein said platform includes blowout prevention equipment in conjunction with a lower riser package.

7. The system according to claim 1 wherein said riser is a compliant riser.

8. The system according to claim 1 said platform is unmanned.

9. The system according to claim 1 wherein said production pipeline includes at least one access port between the well and said host facility.

10. The system according to claim 1 wherein said production pipeline includes at least one access port between the well and said host facility and said access port is adapted to allow insertion of a pig into the production pipeline.

11. The system according to claim 1 wherein said production pipeline includes at least one access port between the well and said host facility and said access port is adapted to allow injection of chemicals into said production pipeline.

12. The system according to claim 1 wherein said control umbilical includes equipment for control of at least one of: subsea equipment, hydraulic and electric power units on the sea floor.

13. The system according to claim 1 wherein said platform is controlled via a remote, non-physical links.

14. The system of claim 13 wherein the remote non-physical link comprises microwave communication, satellite communication, or radio communication.

15. The system of claim 1 wherein the deep subsea well is at a depth of at least about 10,000 feet.

16. The system of claim 1 wherein the riser is at a depth of at least about 2500 feet.

17. A system for producing hydrocarbons from a subsea well, comprising:

a floating platform positioned over the well, said platform including equipment for inserting coiled tubing into the well;

a vertical access riser connecting said platform to the well;

a control umbilical connecting said platform to the well;

a host facility adapted to receive the produced hydrocarbons; and a production pipeline connecting the well to said host facility, said production pipeline including at least one access port between the well and said host facility.

18. The system according to claim 17 wherein said platform includes well intervention equipment.

19. The system according to claim 17 wherein said platform includes storage for chemicals.

20. The system according to claim 17 wherein said platform includes chemical injection equipment.

21. The system according to claim 17 wherein said platform includes blowout prevention equipment.

22. The system according to claim 17 wherein said access port is adapted to allow insertion of a pig into said production pipeline.

23. The system according to claim 17 wherein said access port is adapted to allow injection of chemicals into said production pipeline.

24. The system according to claim 17 wherein said platform is controlled via a remote, non-physical links.

25. The system of claim 24 wherein the remote non-physical link comprises microwave communication, satellite communication, or radio communication.

26. The system of claim 17 wherein the deep subsea well is at a depth of at least about 10,000 feet.

27. The system of claim 17 wherein the riser is at a depth of at least about 2500 feet.

28. A method for producing hydrocarbons from a subsea well; comprising:

providing a floating platform positioned over the well;

providing a vertical access riser connecting the platform to the well;

providing a host facility adapted to receive the produced hydrocarbons;

providing a production pipeline connecting the well to said host facility;

producing the hydrocarbons from the well through the production pipeline to the host facility; and controlling the production of hydrocarbons through the control umbilical.

29. The method according to claim 28, further including the step of inserting coiled tubing into the well through the vertical access riser.

30. The method according to claim 28, further including the step of injecting chemicals into the well through the vertical access riser.

31. The method according to claim 28 wherein said production pipeline includes at least one access port between the well and said host facility, further including the step of injecting chemicals through the access port.

32. The method according to claim 28 wherein said production pipeline includes at least one access port between the well and said host facility, further including the step of inserting a pig into said production pipeline.

33. The system according to claim 28 wherein said platform is controlled via a remote, non-physical links.

34. The system of claim 33 wherein the remote non-physical link comprises microwave communication, satellite communication, or radio communication.

35. The system of claim 28 wherein the deep subsea well is at a depth of at least about 10,000 feet.

36. The system of claim 28 wherein the riser is at a depth of at least about 2500 feet.

* * * * *

UNITED STATES PATENT AND TRADEMARK OFFICE

CERTIFICATE OF CORRECTION

PATENT NO. : 6,536,528 B1
DATED : March 25, 2003
INVENTOR(S) : Amin et al.

It is certified that error appears in the above-identified patent and that said Letters Patent is hereby corrected as shown below:

Column 5, line 16 through Column 8, line 4,
Claims 1-36 should read as follows:

What is claimed is:

1. A system for producing hydrocarbons from a deep subsea well, comprising:

a floating platform positioned over the deep well;

a vertical access riser connecting said platform to the deep well, said vertical access riser allowing well-servicing operations to be performed from said floating platform;

a control umbilical connecting said platform to the deep well without passing through an intermediate storage facility, said control umbilical providing for control of the well, the length of said control umbilical being approximately equal to the water depth at the location of the deep well;

a host facility adapted to receive the produced hydrocarbons; and a production pipeline connecting the deep well to said host facility without passing through said floating platform.

2. The system according to claim 1 wherein said platform includes equipment for inserting coiled tubing into the deep well.

3. The system according to claim 1 wherein said platform includes well intervention equipment.

4. The system according to claim 1 wherein said platform includes storage for chemicals.

5. The system according to claim 1 wherein said platform includes chemical injection equipment.

6. The system according to claim 1 wherein said platform includes blowout prevention equipment in conjunction with a lower riser package.

7. The system according to claim 1 wherein said riser is a compliant riser.

8. The system according to claim 1 said platform is unmanned.

9. The system according to claim 1 wherein said production pipeline includes at least one subsea access port between the deep well and said host facility.

10. The system according to claim 1 wherein said production pipeline includes at least one subsea access port between the deep well and said host facility and said subsea access port is adapted to allow insertion of a pig into the production pipeline.

11. The system according to claim 1 wherein said production pipeline includes at least one subsea access port between the deep well and said host facility and said subsea access port is adapted to allow injection of chemicals into said production pipeline.

12. The system according to claim 1 wherein said control umbilical includes equipment for control of at least one of: subsea equipment, hydraulic and electric power units on the sea floor.

13. A system for producing hydrocarbons from a deep subsea well, comprising:

a floating platform positioned over the deep well, said platform including equipment for inserting coiled tubing into the well;

It is certified that error appears in the above-identified patent and that said Letters Patent is hereby corrected as shown below:

Column 5 (cont'd), a floating platform positioned over the deep well, said platform including equipment for inserting coiled tubing into the well;

a vertical access riser connecting said platform to the deep well, said vertical access riser allowing well-servicing operations to be performed from said floating platform;

a control umbilical connecting said platform to the deep well without passing through an intermediate storage facility, said control umbilical providing for control of the well, the length of said control umbilical being approximately equal to the water depth at the location of the deep well;

a host facility adapted to receive the produced hydrocarbons; and a production pipeline connecting the deep well to said host facility without passing through said floating platform, said production pipeline including at least one subsea access port between the deep well and said host facility.

14. The system according to claim 13 wherein said platform includes well intervention equipment.

15. The system according to claim 13 wherein said platform includes storage for chemicals.

16. The system according to claim 13 wherein said platform includes chemical injection equipment.

17. The system according to claim 13 wherein said platform includes blowout prevention equipment.

18. The system according to claim 13 wherein said subsea access port is adapted to allow insertion of a pig into 18. The system according to claim 13 wherein said subsea access port is adapted to allow insertion of a pig into said production pipeline.

19. The system according to claim 13 wherein said subsea access port is adapted to allow injection of chemicals into said production pipeline.

20. A method for producing hydrocarbons from a deep subsea well; comprising:

providing a floating platform positioned over the deep well;

providing a vertical access riser connecting the platform to the deep well, said vertical access riser allowing well-servicing operations to be performed from said floating platform;

providing a control umbilical connecting the platform to the deep well without passing through an intermediate storage facility, said control umbilical providing for control of the well, the length of said control umbilical being approximately equal to the water depth at the location of the deep well;

providing a host facility adapted to receive the produced hydrocarbons;

providing a production pipeline connecting the deep well to said host facility without passing through said floating platform;

producing the hydrocarbons from the deep well through the production pipeline to the host facility; and controlling the production of hydrocarbons through the control umbilical.

It is certified that error appears in the above-identified patent and that said Letters Patent is hereby corrected as shown below:

Column 5 (cont'd), controlling the production of hydrocarbons through the control umbilical.

21. The method according to claim 20, further including the step of inserting coiled tubing into the deep well through the vertical access riser.

22. The method according to claim 20, further including the step of injecting chemicals into the deep well through the vertical access riser.

23. The method according to claim 20 wherein said production pipeline includes at least one subsea access port between the deep well and said host facility, further including the step of injecting chemicals through the subsea access port.

24. The method according to claim 20 wherein said production pipeline includes at least one subsea access port between the deep well and said host facility, further including the step of inserting a pig into said subsea production pipeline.

25. The system according to claim 1 wherein said platform is controlled via a remote, non-physical links.

26. The system of claim 25 wherein the remote non-physical link comprises microwave communication, satellite communication, or radio communication.

UNITED STATES PATENT AND TRADEMARK OFFICE

CERTIFICATE OF CORRECTION

PATENT NO. : 6,536,528 B1
DATED : March 25, 2003
INVENTOR(S) : Amin et al.

It is certified that error appears in the above-identified patent and that said Letters Patent is hereby corrected as shown below:

Column 5 (cont'd), satellite communication, or radio communication.

27. The system according to claim 13 wherein said platform is controlled via a remote, non-physical links.

28. The system of claim 27 wherein the remote non-physical link comprises microwave communication, satellite communication, or radio communication.

29. The system according to claim 20 wherein said platform is controlled via a remote, non-physical links.

30. The system of claim 29 wherein the remote non-physical link comprises microwave communication, satellite communication, or radio communication.

31. The system of claim 1 wherein the deep subsea well is at a depth of at least about 10,000 feet.

32. The system of claim 1 wherein the riser is at a depth of at least about 2500 feet.

33. The system of claim 13 wherein the deep subsea well is at a depth of at least about 10,000 feet.

34. The system of claim 13 wherein the riser is at a depth of at least about 2500 feet.

35. The system of claim 20 wherein the deep subsea well is at a depth of at least about 10,000 feet.

36. The system of claim 20 wherein the riser is at a depth of at least about 2500 feet.

Signed and Sealed this

Fourteenth Day of September, 2004

JON W. DUDAS
*Director of the United States Patent and Trademark Office*